United States Patent [19]

Hirano et al.

[11] Patent Number: 4,828,973

[45] Date of Patent: May 9, 1989

[54] SILVER HALIDE PHOTOGRAPHIC MATERIAL WITH HETEROCYCLIC QUATERNARY AMMONIUM NUCLEATING AGENT

[75] Inventors: Shigeo Hirano; Ashita Murai; Seiji Suzuki, all of Kanagawa, Japan

[73] Assignee: Fuji Photo Film Co., Ltd., Ashigara, Japan

[21] Appl. No.: 21,652

[22] Filed: Mar. 4, 1987

[30] Foreign Application Priority Data

Mar. 7, 1986 [JP] Japan ..... 61-49692

[51] Int. Cl.[4] ..... G03C 1/08; G03C 1/485

[52] U.S. Cl. ..... 430/598; 430/600

[58] Field of Search ..... 430/598

[56] References Cited

U.S. PATENT DOCUMENTS 4,115,122 9/1978 Adachi et al. ..... 430/598

4,471,044 9/1984 Parton et al. ..... 430/598

OTHER PUBLICATIONS

Research Disclosure (23510), Nov. 1983.

*Primary Examiner*—Richard L. Schilling

*Attorney, Agent, or Firm*—Burns, Doane, Swecker & Mathis

[57] ABSTRACT

A silver halide photographic material is described, which comprises a support having provided thereon at least one hydrophilic layer containing at least one alkynyl-substituted heterocyclic quaternary ammonium salt represented by the following general formula (I):

(I)

wherein Z represents non-metallic atoms necessary for forming a 5- or 6-membered heterocyclic nucleus;

$R^1$ represents an aliphatic group, and $R^2$ represents a hydrogen atom, an aliphatic group or an aromatic group, at least one of $R^1$, $R^2$ and Z having an alkynyl group, and at least one of the substituents $R^1$ and Z including the group $X\text{-}(L)_m\text{-}$ wherein X represents a group effective for accelerating adsorption onto silver halide grains and L represents a divalent linking group;

Y represents a charge-balancing counter ion;

n represents 0 or 1; and m represents 0 or 1.

19 Claims, No Drawings

SILVER HALIDE PHOTOGRAPHIC MATERIAL WITH HETEROCYCLIC QUATERNARY AMMONIUM NUCLEATING AGENT

FIELD OF THE INVENTION

This invention relates to direct positive silver halide photographic materials and negative-working surface latent image-forming silver halide photographic materials, which contain a novel adsorption-type alkynyl substituted quaternary ammonium salt nucleating agent.

BACKGROUND OF THE INVENTION

Nucleating agents have conventionally been used in silver halide photographic materials for various purposes. For example, hydrazines are used as nucleus-forming agents in direct positive internal latent image-forming silver halide emulsions, and as agents for increasing sensitivity and/or gradation in negative-working surface latent image-forming silver halide emulsions.

Among various direct positive photographic processes, a process of exposing previously fogged silver halide grains in the presence of a desensitizing agent and a process of exposing a silver halide emulsion having light-sensitive nuclei primarily within silver halide grains and developing it in the presence of a nucleating agent, are most useful. The present invention relates to the latter. Silver halide emulsions having light-sensitive nuclei primarily within silver halide grains and forming a latent image mainly within the grains are called internal latent image-type silver halide emulsions, and are discriminated from silver halide grains forming a latent image primarily on the surface of silver halide grains.

Processes for obtaining direct positive images by surface-developing internal latent image-type silver halide photographic emulsions in the presence of a nucleating agent and photographic emulsions or light-sensitive materials to be used for such processes are known. Examples of such processes, emulsions and materials can be found in U.S. Pat. Nos. 2,456,953, 2,497,875, 2,497,876, 2,588,982, 2,592,250, 2,675,318, 3,227,552 and 3,317,322, British Pat. Nos. 1,011,062, 1,151,363, 1,269,640 and 2,011,391, Japanese Patent Publication Nos. 29405/68 and 38164/74 and Japanese Patent Application (OPI) Nos. 16623/78, 137133/78, 37732/79, 40629/79, 74536/79, 74729/79, 52055/80 and 90940/80 (the term "OPI" as used herein refers to a "published unexamined Japanese patent application").

In the above-described direct positive image-forming processes, the nucleating agents have been added to a developer, but it has been more popular to add the nucleating agent to photographic emulsion layers or other proper layers of a light-sensitive material.

As the nucleating agents to be added to silver halide light-sensitive materials, hydrazine compounds are most known and are described in U.S. Pat. Nos. 2,563,785, 2,588,982 and 3,227,552. However, in the case of adding these hydrazine compounds to light-sensitive materials, the compounds must be used in considerably high concentrations (e.g., about 2 g per mol of silver). Furthermore, since the nucleating agents migrate from emulsion layers into a developer during development processing, the concentration of the nucleating agent in the emulsion changes to cause uneven photographic density. In addition, with multilayer color light-sensitive materials, unbalanced nucleating effects result between the emulsion layers, which leads to formation of unbalanced colors. In order to overcome these disadvantages, there have been developed hydrazine-type nucleating agents having a substituent or substituents capable of adsorbing onto the surface of silver halide grains. Typical hydrazine-type nucleating agents having an adsorption-accelerating group include thioureabound acylphenylhydrazine-type compounds such as those described in U.S. Pat. Nos. 4,030,925, 4,031,127, 4,139,387, 4,243,739, 4,245,037, 4,255,511 and 4,276,364 and British Pat. No. 2,012,443. Further, there are those compounds which have a heterocyclic thioamido group as an adsorptive group described in U.S. Pat. No. 4,080,207, phenylacylhydrazine compounds having a heterocyclic group having a mercapto group as an adsorptive group such as those described in British Pat. No. 2,011,397B, sensitizing dyes having a nucleating substituent within the molecular structure such as those described in U.S. Pat. No. 3,718,470, and those compounds which are described in Japanese Patent Application (OPI) Nos. 200230/84, 212828/74 and 212829/84, Research Disclosure, No. 23510 (November, 1953), ibid., No. 15162 (November, 1976, Vol. 151) and ibid., No. 17626 (December, 1978, Vol. 176).

In general, hydrazine-type nucleating agents are particularly effective in discrimination since they provide a large difference between maximum density (Dmax) and minimum density (Dmin), but they have the disadvantage in that they require a high pH for photographic processing (pH$>$11). As nucleating agents capable of exerting their function even at a low pH (pH$<$11), heterocyclic quaternary ammonium salts are known. Examples thereof are described in U.S. Pat. Nos. 3,615,615, 3,719,494, 3,734,738, 3,759,901, 3,854,956, 4,094,683 and 4,306,016, British Pat. No. 1,283,835 and Japanese Patent Application (OPI) Nos. 3426/77 and 69613/77. Propargyl- or butynyl-substituted heterocyclic quaternary ammonium salt compounds described in U.S. Pat. No. 4,115,122 are particularly effective nucleating agents for discrimination when used in direct positive silver halide emulsions. However, silver halide emulsions, particularly color light-sensitive materials, contain sensitizing dyes for the purpose of spectral sensitization. Therefore, competition of adsorption onto silver halide emulsion takes place between the sensitizing dye and the heterocyclic quaternary ammonium-type nucleating agent, and since the quaternary salt-type nucleating agents have weak adsorbing ability, they must be added in large quantities. Particularly with multilayer color light-sensitive materials, however, uneven density and unbalanced color may result. Consequently, the quaternary salt-type nucleating agents still have insufficient properties. For the purpose of solving this problem, examples of quaternary salt-type nucleating agents having an AgX adsorption-accelerating thioamido group are reported in U.S. Pat. No. 4,471,044. This patent reports that the amount of the nucleating agent necessary for obtaining enough Dmax can be reduced and a decrease in Dmax with time at high temperature can be reduced by introduction of the adsorptive group. Actually, however, the above effect has not been achieved to a fully satisfactory level.

It is known that a high contrast negative image having a large gamma ($>$10) can be obtained by processing a surface latent image type silver halide negative-working emulsion using a processing solution with a high pH ($>$11) in the presence of a hydrazine-type nucleating agent. Such a process is described in, for example, U.S.

Pat. Nos. 2,419,975, 4,224,401, 4,168,977, 4,243,739, 4,272,614 and 4,323,643. U.S. Pat. Nos. 4,385,108 and 4,269,929 describe examples of hydrazine-type nucleating agents having a group capable of accelerating adsorption of the agents onto silver halide grains. It is further known that, when a negative-working emulsion combined with a hydrazine compound is processed at a lower pH (<11), enhanced sensitivity is obtained. It is also known that in silver halide negative-working emulsion systems, quaternary ammonium salt-type compounds exert development-accelerating function. This is described in, for example, U.S. Pat. No. 4,135,931, Japanese Patent Application Nos. 114328/77 and 121321/77, German Pat. No. 2,647,940 and Belgian Pat. No. 721,568.

However, in many cases, these hydrazine-type nucleating agents cause a deterioration of graininess and a change of gradation by infectious development. In addition, conventional quaternary ammonium salt-type compounds may elute into a processing solution. Consequently, the hydrazine-type nucleating agent and the quaternary ammonium salt-type compound have not been achieved to a fully satisfactory level in a surface latent image-type silver halide negative-working emulsion.

SUMMARY OF THE INVENTION

An object of the present invention is to provide a direct positive light-sensitive material which shows reversal properties even when processed with a processing solution having a comparatively low pH.

Another object of the present invention is to provide a direct positive light-sensitive material which contains a nucleating agent that exerts, even when added in small amounts, a desired nucleating effect without inhibiting spectral sensitization.

A further object of the present invention is to provide a multilayer color direct positive light-sensitive material capable of forming an image with uniform density and good color balance.

Still a further object of the present invention is to provide a direct positive light-sensitive material which undergoes less change in photographic properties such as reduction in Dmax with time under conditions of high temperature and high humidity.

Still a further object of the present invention is to provide a negative-working light-sensitive material having increased photographic sensitivity.

These and other objects of the present invention will become apparent from the following description thereof.

The above-described and other objects of the present invention have been attained by incorporating in at least one hydrophilic layer of a silver halide light-sensitive material, preferably an internal latent image-type silver halide photographic emulsion layer in the case of positive-working light-sensitive material or a surface latent image-type silver halide photographic emulsion layer in the case of negative-working light-sensitive material, or a hydrophilic colloidal layer adjacent thereto, a heterocyclic quaternary ammonium salt compound represented by the following general formula (I):

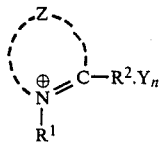

(I)

wherein Z represents non-metallic atoms necessary for forming a 5- or 6-membered heterocyclic nucleus and may be substituted by a proper substituent or substituents;

$R^1$ represents an aliphatic group, and $R^2$ represents a hydrogen atom, an aliphatic group or an aromatic group, with $R^1$ and $R^2$ being optionally substituted by a proper substituent or substituents; at least one of $R^1$, $R^2$ and Z having an alkynyl group; and at least one of the substituents of $R^1$ and Z having $X\text{-}(L)_m$- wherein X represents a group capable of accelerating adsorption onto silver halide grains selected from among a mercapto group and a 5- or 6-membered nitrogen-containing heterocyclic group, and L represents a divalent linking group;

Y represents a charge-balancing counter ion;

n represents 0 or 1; and m represents 0 or 1.

DETAILED DESCRIPTION OF THE INVENTION

The heterocyclic nucleus completed by Z may be a quinolinium nucleus, a benzothiazolium nucleus, a benzimidazolium nucleus, a pyridinium nucleus, a thiazolinium nucleus, a thiazolium nucleus, a naphthothiazolium nucleus, a selenazolium nucleus, a benzoselenazolium nucleus, an imidazolium nucleus, a tetrazolium nucleus, an indolenium nucleus, a pyrrolinium nucleus, an acridinium nucleus, a phenanthridinium nucleus, an isoquinolinium nucleus, an oxazolium nucleus, a naphthoxazolium nucleus, and a benzoxazolium nucleus.

Suitable substituents for Z include an alkyl group preferably containing 1 to 18 carbon atoms, such as a methyl group, an ethyl group or a cyclohexyl group, an alkenyl group preferably containing 2 to 18 carbon atoms, such as a vinyl group, an allyl group or a butenyl group, an alkynyl group preferably containing 2 to 18 carbon atoms, such as an ethynyl group, a propargyl group or a butynyl group, an aralkyl group preferably containing 7 to 20 carbon atoms, such as a benzyl group, an aromatic group preferably containing 6 to 20 carbon atoms, such as a phenyl group or a naphthyl group, a hydroxy group, an aliphatic oxy group (e.g., an alkoxy group, an alkenyloxy group or an alkynyloxy group) preferably containing 1 to 18 carbon atoms, such as a methoxy group, an ethoxy group, an aryloxy group, a propargyloxy group or a butynyloxy group, an aromatic oxy group preferably containing 6 to 20 carbon atoms such as a phenyloxy group, a halogen atom such as a fluorine atom, a chlorine atom, a bromine atom or an iodine atom, an amino group, a substituted amino group preferably containing 1 to 18 carbon atoms such as a methylamino group, a dimethylamino group, a propargylamino group or a phenylamino group, an aliphatic thio group preferably containing 1 to 18 carbon atoms, such as a methylthio group or a propargylthio group, an aromatic thio group preferably containing 6 to 20 carbon atoms such as a phenylthio group, an acyloxy group preferably containing 1 to 18 carbon atoms such as an acetoxy group or a benzoxy group, a sulfonyloxy group preferably containing 1 to 18 carbon atoms such as a methanesulfonyloxy group or a toluenesulfonyloxy group, an acylamino group preferably containing 1 to 18 carbon atoms such as an acetylamino group or a benzoylamino group, a sulfonylamino group preferably containing 1 to 18 carbon atoms such as a methanesulfonylamino group or a benzenesulfonylamino group, a carboxyl group, an aliphatic oxy carbonyl group preferably containing 1 to 18 carbon atoms such as a methoxycarbonyl group or a propargyloxycarbonyl group, an aromatic oxy carbonyl group preferably containing 7 to 20 carbon atoms such as a phenoxycarbonyl group, an acyl group preferably containing 1 to 20 carbon atoms such as a formyl group, an acetyl group or a benzoyl group, a carbamoyl group, an N-substituted carbamoyl group preferably containing 2 to 20 carbon atoms such as an N-methylcarbamoyl group, an N-propargylcarbamoyl group or an N-phenylcarbamoyl group, a sulfamoyl group, an N-substituted sulfamoyl group preferably containing 1 to 18 carbon atoms such as an N-methylsulfamoyl group, an N,N-dimethylsulfamoyl group, an N-butynylsulfamoyl group or an N-phenylsulfamoyl group, a sulfo group, a cyano group, a ureido group, a substituted ureido group preferably containing 2 to 20 carbon atoms such as a 3-methylureido group, a 3-propargylureido group or a 3-phenylureido group, a substituted urethane group preferably containing 2 to 20 carbon atoms such as a methoxycarbonylamino group, a propargyloxycarbonylamino group or a phenoxycarbonylamino group, a carbonate group preferably containing 2 to 20 carbon atoms, such as an ethoxycarbonyloxy group, a propargyloxycarbonyloxy group, or a phenoxycarbonyloxy group, and a substituted or unsubstituted imino group preferably containing up to 18 carbon atoms such as an N-methylimino group or an N-propargylimino group.

As the substituent for Z, at least one substituent is selected from among the above-described substituents and, when two or more substituents exist, they may be the same or different. The above-described substituents may themselves be substituted by the described substituents.

Specific examples of the heterocyclic nucleus completed by Z include the following. (1) Quinolinium nucleus: quinolinium, quinaldinium, lepidinium, 6-ethoxyquinaldinium, 6-propargyloxyquinaldinium, 2,4-dimethylquinolinium, 3-acetylaminoquinolinium, and 6-acetylaminoquinaldinium nuclei; (2) benzothiazolium nucleus 2-methylbenzothiazolium, 5-hydroxybenzothiazolium, 2-methyl-5-propargyloxybenzothiazolium, 2,5,6-trimethylbenzothiazolium, 2-methyl-5-phenylbenzothiazolium, and 5-chlorobenzothiazolium nuclei; (3) benzimidazolium nucleus: 1-ethyl-5,6-dichloro-2-methylbenzimidazolium, 1-ethyl-2-methylbenzimidazolium, and 5,6-dichloro-2-methyl-1-phenylbenzimidazolium nuclei; (4) pyridinium nucleus: pyridinium, 2-methylpyridinium, 2,4,6-trimethylpyridinium, and 4-phenylpyridinium nuclei; (5) thiazolinium nucleus: 2-methyl-2-thiazolinium, and 2-p-hydroxyphenyl-5-methyl-2-thiazolinium nuclei; (6) thiazolium nucleus: thiazolium, 2,4-dimethylthiazolium, and 2,4,5-trimethylthiazolium nuclei; (7) naphthothiazolium nucleus: α-naphthothiazolium, 5-methoxy-2-methyl-β-naphthothiazolium, and 7-hydroxy-2-methyl-α-naphthothiazolium nuclei; (8) selenazolium nucleus: selenazolium and 2-methyl-4-phenylselenazolium nuclei; (9) benzoselenazolium nucleus: benzoselenazolium, 5-chloro-2-methylbenzoselenazolium, and 5-chloro-2-methylbenzoselenazolium nuclei; (10) imidazolium nucleus: 1,2-dimethylimidazolium and 1-ethyl-2,4,5-trimethylimidazolium nuclei; (11) tetrazolium nucleus: tetrazolium, 1-phenyltetrazolium, 2-phenyltetrazolium, and 1,5-dimethyltetrazolium nuclei; (12) indolenium nucleus: indolenium and 3,3-dimethylindolenium nuclei; (13) pyrrolinium nucleus: 2-methylpyrrolinium nucleus; (14) acridinium nucleus: acridinium and 9-methylacridinium nuclei; (15) phenanthridinium nucleus: phenanthridinium and 6-methylphenanthridinium nuclei; (16) isoquinolinium nucleus: isoquinolinium and 5-hydroxyisoquinolinium nuclei; (17) oxazolium nucleus: oxazolium, 2,4-dimethyloxazolium, and 2-methyl-4,5-diphenyloxazolium nuclei; (18) naphthoxazolium nucleus: α-naphthoxazolium, 2-methyl-β,β-naphthoxazolium, and 7-hydroxy-2-methyl-β-naphthoxazolium nuclei; and (19) benzoxazolium nucleus: benzoxazolium, 5-chloro-2-methylbenzoxazolium, 2,5-dimethylbenzoxazolium, 5-chloro-2-methylbenzoxazolium, and 6-hydroxy-2-methylbenzoxazolium nuclei.

Preferable examples of the heterocyclic nucleus completed by Z include a quinolinium nucleus, a benzothiazolium nucleus, a benzimidazolium nucleus, a pyridinium nucleus, an acridinium nucleus, a phenanthridinium nucleus, or an isoquinolinium nucleus.

A quinolinium nucleus, a benzothiazolium nucleus, and a benzimidazolium nucleus are more preferable, with a quinolinium nucleus being most preferable.

The aliphatic groups represented by $R^1$ and $R^2$, which may be the same or different, may be unsubstituted alkyl groups containing 1 to 18 carbon atoms (e.g., a methyl group, an ethyl group, an isopropyl group, or a hexadecyl group) and substituted alkyl groups containing 1 to 18 carbon atoms in the alkyl moiety. As the substituents, there are illustrated those referred to as substituents for Z and examples thereof include a sulfoalkyl group (e.g., a 2-sulfoethyl group, a 3-sulfopropyl group or a 4-sulfobutyl group), a carboxyalkyl group (e.g., a 2-carboxyethyl group), a hydroxyalkyl group (e.g., a 2-hydroxyethyl group), an alkoxyalkyl group (e.g., a 2-methoxyethyl group, a 2-hydroxyethoxymethyl group, a 2-methoxyethoxy group), an acyloxyalkyl group (e.g., a 2-acetoxyethyl group), a dialkylaminoalkyl group (e.g., a 2-dimethylaminoethyl group), an aralkyl group (e.g., a benzyl group), an alkenyl group (e.g., an allyl group), an alkynyl group (e.g., a propargyl group, a 3-butynyl group, a 2-butynyl group, a 4-pentynyl group, a 3-butyn-2-yl group, a 1-phenylpropargyl group or a 3-phenylpropargyl group).

The aromatic group represented by $R^2$ contains 6 to 20 carbon atoms and may be a phenyl group or a naphthyl group. As the substituents therefor, there are illustrated those mentioned as substituents for Z, and examples thereof include an alkyl-substituted aryl group (e.g., a 4-methylphenyl group), an alkoxyaryl group (e.g., a 3-methoxyphenyl group or a 4-propargyloxyphenyl group), a hydroxyaryl group (e.g., a 4-hydroxyphenyl group), a halogen-substituted aryl group (e.g., a 4-chloro-1-naphthyl group) or a sulfoaryl group (e.g., a 4-sulfophenyl group, etc.).

The alkynyl substituent at least one of $R^1$, $R^2$ and Z possesses has been partly described and, to describe in more detail, the alkynyl substituent preferably contains 2 to 18 carbon atoms and may be an ethynyl group, a propargyl group, a 2-butynyl group, a 1-methylpropargyl group, a 1,1-dimethylpropargyl group, a 3-butynyl group or a 4-pentynyl group.

These may further be substituted by those substituents which have been mentioned as substituents for Z. Examples thereof include a 3-phenylpropargyl group, a 3-methoxycarbonylpropargyl group or a 4-methoxy-2-butynyl group.

As the 5- to 6-membered nitrogen-containing heterocyclic group represented by X, there are illustrated those which comprise a combination of carbon and nitrogen, oxygen or sulfur.

Preferable examples thereof include a benzotriazolyl group, a triazolyl group, a tetrazolyl group, an indazolyl group, a benzimidazolyl group, an imidazolyl group, a benzothiazolyl group, a thiazolyl group, a benzoxazolyl group, an oxazolyl group, a thiadiazolyl group, an oxadiazolyl group or a triazinyl group. These groups may have a proper substituent or substituents. As the substituents, there are illustrated those which have been mentioned as substituents for Z. More preferable examples thereof are a benzotriazolyl group, a triazolyl group, a tetrazolyl group, and an indazolyl group, with a benzotriazolyl group being the most preferable.

Preferably, the 5- or 6-membered nitrogen-containing heterocyclic group includes a benzotriazol-5-yl group, a 6-chlorobenzotriazol-5-yl group, a benzotriazol-5-carbonyl group, a 5-phenyl-1,3,4-triazol-2-yl group, a 4-(5-methyl-1,3,4-triazol-2-yl)benzoyl group, a 1H-tetrazol-5-yl group or a 3-cyanoindazol-5-yl group.

The mercapto group represented by X is directly bound to $R^1$ or Z, or may be bound to a substituent in $R^1$ or Z. The mercapto group is exemplified by an aliphatic mercapto group, an aromatic mercapto group, or a heterocyclic mercapto group (in this case, the carbon atom to which SH group is bound not being adjacent to nitrogen atom). Examples of an aliphatic mercapto group include mercaptoalkyl groups (e.g., a mercaptoethyl group or a mercaptopropyl group), mercaptoalkenyl groups (e.g., a mercaptopropenyl group), and mercaptoalkynyl groups (e.g., a mercaptobutynyl group). Examples of the aromatic mercapto groups include mercaptophenyl groups and mercaptonaphthyl groups. Examples of the heterocyclic mercapto group include 4-mercaptopyridyl groups, 5-mercaptoquinolinyl groups and 6-mercaptobenzothiazolyl groups.

The divalent linking group represented by L is an atom or atomic group containing at least one of C,N, S and O. Specifically, L comprises an alkylene group, an alkenylene group, an alkynylene group, an arylene group, —O—, —S—, —NH—, —N=, —CO—, —$SO_2$— (these groups optionally having a substituent or substituents), or a combination thereof. Specific examples of L include (1) an alkylene group (preferably containing 1 to 12 carbon atoms, such as a methylene group, an ethylene group or a trimethylene group), (2) an alkenylene group (preferably containing 2 to 12 carbon atoms, such as a vinylene group or a butylene group), (3) an alkynylene group (preferably containing 2 to 12 carbon atoms, such as an ethynylene group or a butynylene group), (4) an arylene group (preferably containing 6 to 10 carbon atoms, such as a phenylene group or a naphthylene group), (5) —O—, (6) —S—, (7) —NH—, (8) —N=, (9) —CO—,

(10) —$SO_2$—, and, as combinations thereof, (11) $-O-\overset{O}{\overset{\|}{C}}-$,

(12) $-NH-\overset{O}{\overset{\|}{C}}-$, (13) —$NHSO_2$—, (14) $-O-\overset{O}{\overset{\|}{C}}NH-$,

(15) $-NH\overset{O}{\overset{\|}{C}}NH-$, (16) —$NHSO_2NH$—, and proper combinations of (1) to (4) and (5) to (16)

(for example, $-(\text{alkylene})-\overset{O}{\overset{\|}{C}}NH-$, —(arylene)—$SO_2NH$— or $-(\text{arylene})-NH\overset{O}{\overset{\|}{C}}NH-$).

The charge-balancing counter ion, Y, is an anion that can counterbalance the positive charge produced by the quaternary ammonium salt in the heterocyclic nucleus and may be a bromide ion, a chloride ion, an iodide ion, a p-toluenesulfonate ion, an ethylsulfonate ion, a perchlorate ion, a trifluoromethanesulfonate ion or a thiocyanate ion. In this case, n represents 1. Where the heterocyclic quaternary ammonium salt further contains an anionic substituent such as a sulfoalkyl substituent, the salt may take the form of betaine. In this case, the counter ion is not necessary, and hence n represents 0. Where the heterocyclic quaternary ammonium salt has two anionic substituents such as two sulfoalkyl groups, Y represents a cationic counter ion such as an alkali metal ion (e.g., a sodium ion or a potassium ion) or an ammonium salt (e.g., a triethylammonium).

Specific examples of the compounds useful in the present invention are illustrated below, these examples, however, do not intend to limit the present invention in any way.

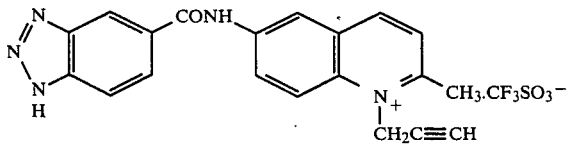

(1)

-continued
(2)
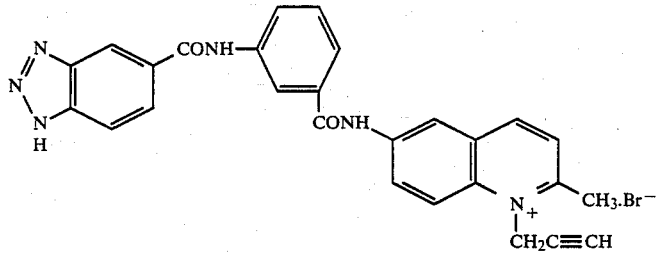
(3)
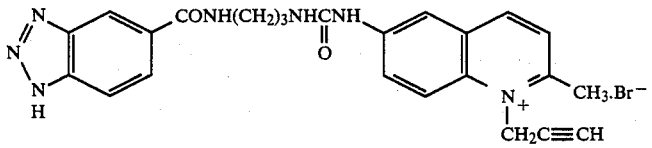
(4)
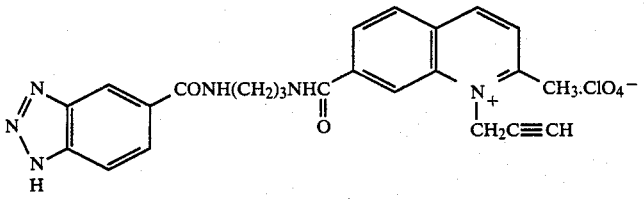
(5)
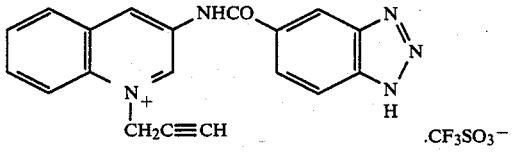
(6)
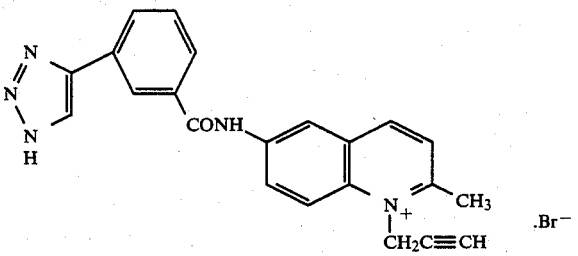
(7)
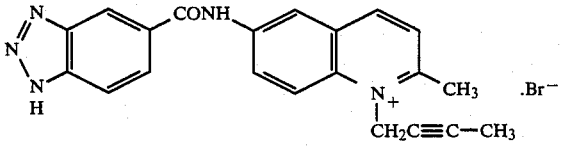
(8)
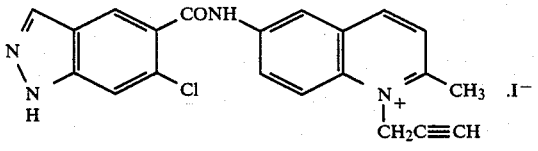
(9)
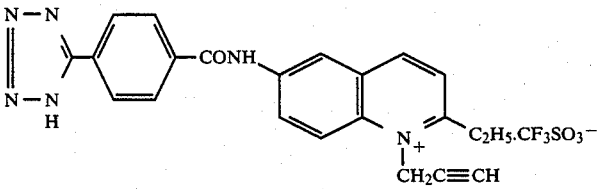

-continued
(10)
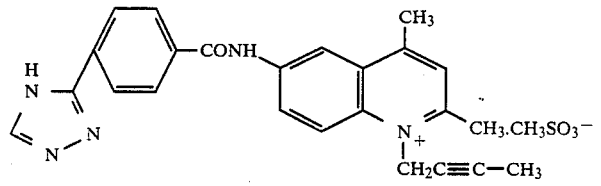
(11)
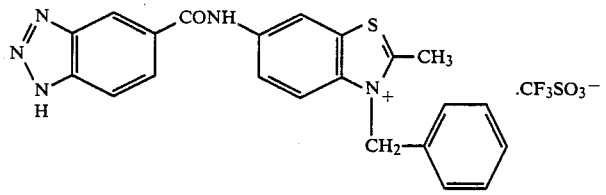
(12)
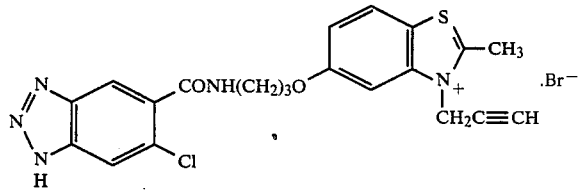
(13)
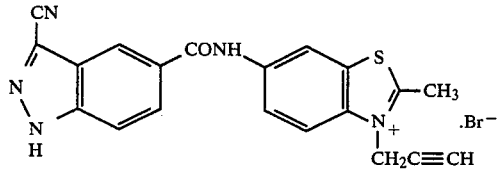
(14)
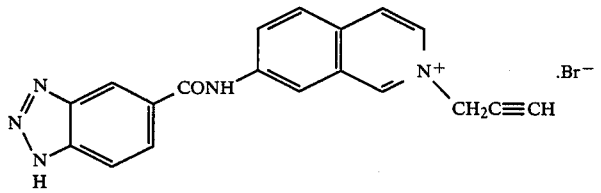
(15)
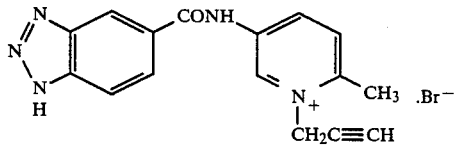
(16)
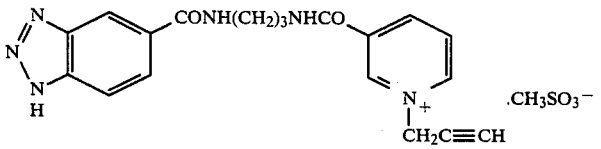
(17)
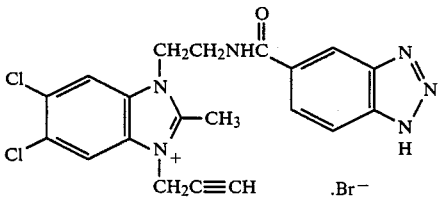

-continued
(18)
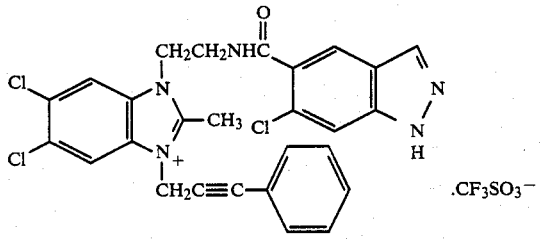
(19)
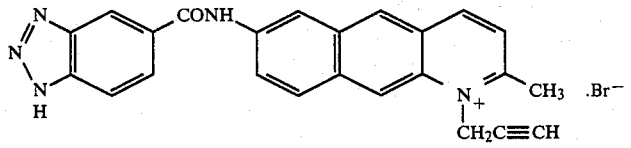
(20)
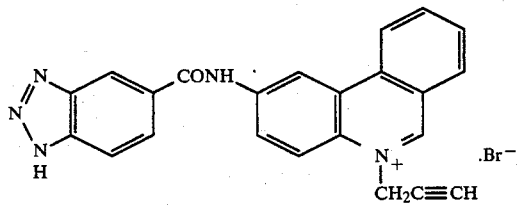
(21)
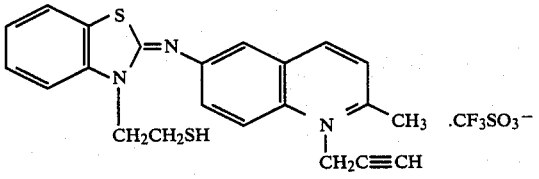
(22)
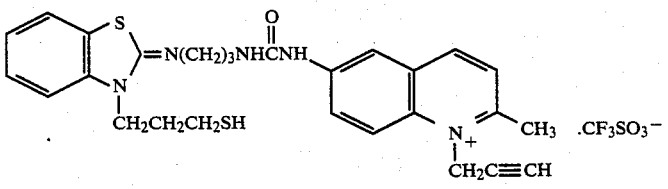
(23)
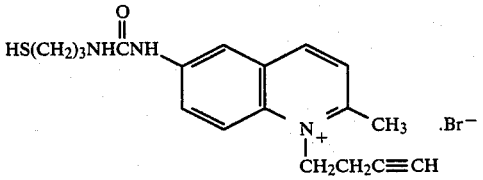
(24)
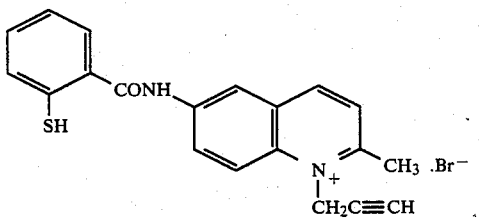
(25)
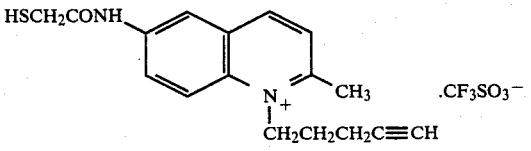

-continued
(26)
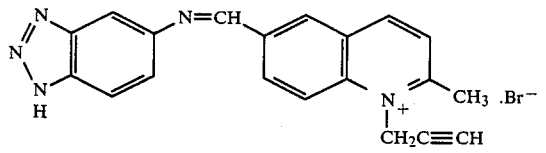
(27)
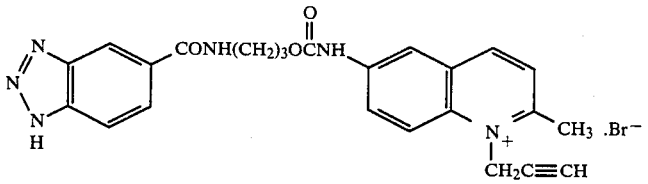
(28)
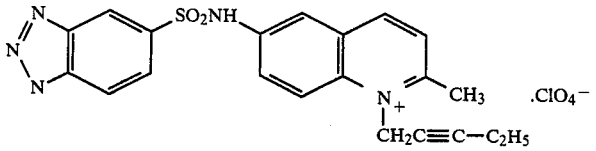
(29)
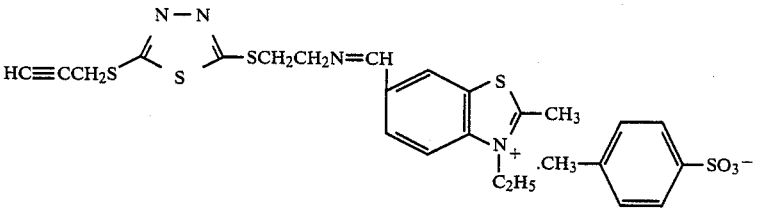
(30)
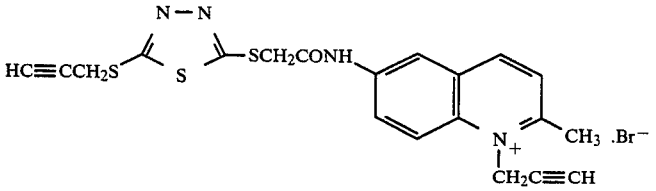
(31)
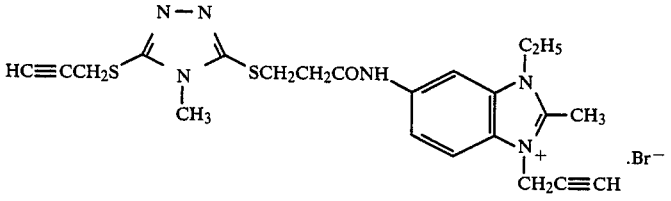
(32)
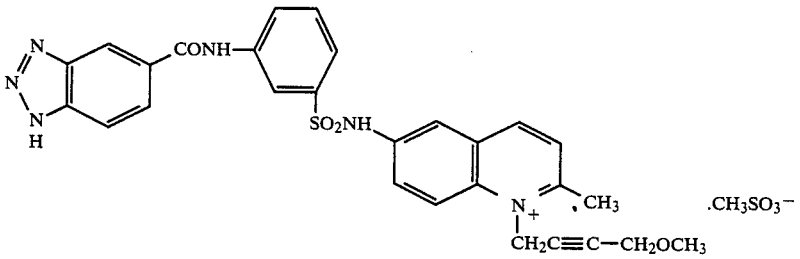
(33)
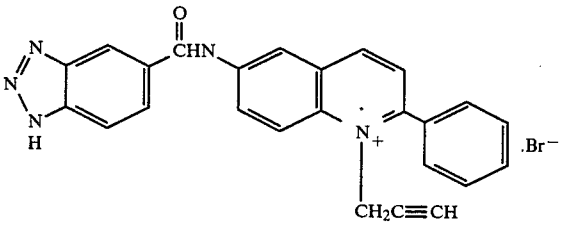

The heterocyclic ring

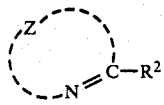

of the present invention and its quaternising can be synthesized by various processes as described, e.g., in A. R. Katritzky and C. W. Rees ed., *Comprehensive Heterocyclic Chemistry, The Structure, Reactions, Synthesis and Use of Heterocyclic Compounds,* Pergamon Press (1984) and articles cited therein. For example, those in which the AgX adsorption-accelerating group, X, is an azole are synthesized according to the following two processes A and B. Process A is a process which involves first linking X to

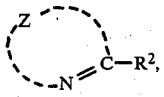

then quaternising the product with a quaternising agent $R^1$-Y. Procss B is a process which involves first quaternising

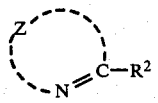

with a quarternising agent $R^1$-Y, then reacting the product with X.

Process A

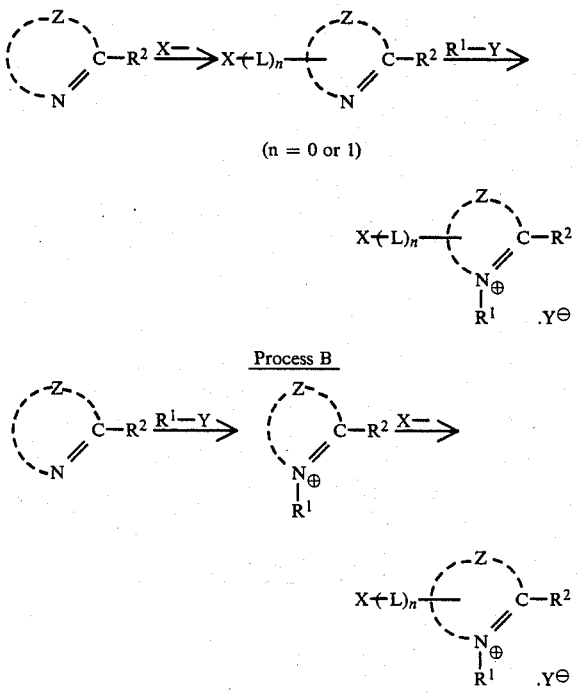

(n = 0 or 1)

Process B (n = 0 or 1)

In the reactions illustrated above, L represents a divalent linking group, and reaction conditions to be employed vary depending upon the kind of L. For example, where L represents a carbonamido group, the group may be introduced in a conventional manner by reacting a carboxylic acid chloride or a phenyl carboxylate derivative with an amine derivative in the presence of a deoxidizer such as pyridine or triethylamine. Alternatively, the group may be introduced by reacting a carboxylic acid derivative with an amine derivative in the presence of a condensing agent such as dicyclohexylcarbodiimide. Where L represents, for example, a sulfonamido group, the compound may be synthesized in a conventional manner by reacting a sulfonic acid chloride derivative with an amine derivative in the presence of a deoxidizer such as pyridine or triethylamine.

Where L represents, for example, a ureido group, the compound may be synthesized by reacting an isocyanate or phenylurethane derivative with an amine derivative.

Where L represents an ether group, the compound may be synthesized by reacting an alcohol derivative with a halide derivative in the presence of an alkali such as potassium carbonate, sodium hydroxide or potassium t-butoxide.

Where L represents an imino group, the compound may be synthesized in a conventional manner by reacting an amine derivative with a carbonyl derivative (an aldehyde or ketone derivative) in the presence of an acid catalyst such as hydrochloric acid or sulfuric acid.

Other linking groups represented by L may also be introduced in a conventional manner.

Quaternisation of

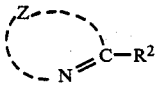

with $R^1$-Y may be conducted by reacting the reactants in the absence of a solvent or in a solvent such as a hydrocarbon such as toluene and xylene, a halogenated hydrocarbon such as chloroform, carbon tetrachloride, 1,2-dichloroethane and 1,1,2,2-tetrachloroethane, or an ether such as tetrahydrofuran and anisole at a temperature of from about room temperature to about 150° C. The reaction product is recovered by adding a solvent which does not solubilize the product such as ethyl acetate or acetone to the reaction mixture, and collecting the precipitated crystals by filtration. Where crystallinity of the product is insufficient, crystallization may be satisfactorily conducted, in many cases, by base exchanging the counter ion $Y^-$ for another counter ion.

Those compounds wherein the AgX adsorption-accelerating group, X, represents a mercapto group may be synthesized according to Process B described above.

The process of synthesizing the compounds of the present invention are described below by reference to specific examples.

SYNTHESIS EXAMPLE 1

Synthesis of Compound (1)

3.2 g of 6-amino-2-methylquinoline, 3,3 g of benzotriazole-5-carboxylic acid, and 4.1 g of dicyclohexylcarbodiimide were reacted in 50 ml of dichloromethane at 50° C. for 3 hours. After allowing the reaction solution to cool, crystals which precipitated were filtered off, and the resulting filtrate referred to as solution (a). Under ice-cooling, 1.0 g of propargyl alcohol was reacted with 5.1 g of trifluoromethanesulfonic acid anhydride in 60 ml of carbon tetrachloride in the presence of 1.4 g of pyridine for 10 minutes. 5 g of anhydrous sodium sulfate was added to the reaction solution, solids were filtered off, and the resulting filtrate referred to as solution (b). Solution (a) and solution (b) were mixed with each other, and were reacted for 5 hours by heating under reflux. After allowing the reaction solution to cool, precipitated crystals were collected by filtration, and recrystallized using 50 ml of ethanol to obtain 4.0 g (yield: 45%) of the end product.

SYNTHESIS EXAMPLE 2

Synthesis of Compound (3)

3.2 g of 6-amino-2-methylquinoline was reacted with 3.1 g of phenyl chloroformate in the presence of 2.0 g of triethylamine in 50 ml of acetonitrile for 3 hours. After allowing the reaction solution to cool, 20 ml of water was added to the reaction mixture, precipitated crystals were collected by filtration, followed by washing with water and drying at 50° C. (yield: 4.4 g).

The crystals thus obtained were reacted with 2.4 g of propargyl bromide in 30 ml of chloroform for 5 hours by heating under reflux. After allowing the reaction solution to cool, precipitated crystals were collected by filtration, washed with ethyl acetate, then air-dried (yield: 5.1 g).

The crystals thus obtained were dissolved in 80 ml of acetonitrile, and 2.5 g of 5-[N-(3-aminopropyl)carbamoyl]benzotriazole was added thereto, followed by reaction for 2 hours by heating under reflux. After allowing the reaction solution to cool, precipitated crystals were collected by filtration, washed with acetone, and recrystallized using ethanol. Yield: 4.4 g (42%).

SYNTHESIS EXAMPLE 3

Synthesis of Compound (11)

3.3 g of 6-amino-2-methylbenzotriazole, 3,3 g of benzotriazole-5-carboxylic acid, and 4.1 g of dicyclohexylcarbodiimide were reacted in 50 ml of dichloromethane for 3 hours at 50° C. After allowing the reaction solution to cool, precipitated crystals were filtered off, and the filtrate thus obtained was mixed with solution (b) prepared in the same manner as in Synthesis Example 1, and reacted for 10 hours by heating under reflux. After allowing the reaction solution to cool, precipitated crystals were collected by filtration, and recrystallized using 70 ml of ethanol to obtain 3.0 g of the end product (yield: 30%).

In the case of incorporating the compound represented by the general formula (I) in a photographic light-sensitive material according to the present invention, it suffices to add the compound to a hydrophilic colloidal solution as a solution in a water-miscible organic solvent such as an alcohol (e.g., methanol, ethanol), an ester (e.g., ethyl acetate) or a ketone (e.g., acetone), or, where the compound is water-soluble, as an aqueous solution.

In adding the compound to a photographic emulsion, the addition may be made at any stage from the initiation of chemical ripening to the stage before coating, with the stage after completion of chemical ripening being preferable.

In the present invention, the nucelating agent represented by the general formula (I) may be incorporated in a hydrophilic colloidal layer adjacent to a silver halide emulsion layer, but is preferably incorporated in a silver halide emulsion layer. The amount of the agent to be added can vary over a wide range since it varies depending upon the properties of silver halide emulsion which is actually used, the chemical structure of the nucleating agent, and the developing conditions. However, the nucleating agent is usefully added in an amount of from about $1\times10^{-7}$ mol to about $1\times10^{-2}$ mol per mol of silver in the silver halide emulsion, preferably from about $1\times10^{-6}$ mol to about $1\times10^{-3}$ mol per mol of silver in the silver halide emulsion.

With positive-working emulsions, the nucleating agent is added preferably in an amount of $1\times10^{-5}$ to $1\times10^{-3}$ mol per mol of silver and, with negative-working emulsions, in an amount of from $1\times10^{-5}$ to $1\times10^{-3}$ mol per mol of silver.

The silver halide photographic light-sensitive materials of the present invention may be light-sensitive materials for photographing use or for printing use, and may be so-called "negative-working" light-sensitive materials capable of forming negative images when exposed to positive photographic objects or direct positive light-sensitive materials capable of forming direct positive images without reversal processing. In addition, the light-sensitive materials may be black-and-white light-sensitive materials (including those for X-ray photography and for silver salt diffusion transfer process) and color light-sensitive materials. As the color light-sensitive materials to which the present invention can be applied, there are various light-sensitive materials such as "conventional" color light-sensitive materials using couplers as dye image-providing compounds (hereinafter referred to as color-forming materials), heat developable color light-sensitive materials, and color diffusion transfer process light-sensitive materials.

The silver halide emulsions to be used in the present invention are usually subjected to chemical sensitization. For example, sulfur sensitization using active gelatin or a sulfur-containing compounds capable of reacting with silver ion such as thiosulfates, thioureas, mercapto compounds and rhodanines, reduction sensitization using reductive substances such as stannous salts, amines, hydrazine derivatives, formamidinesulfinic acids and silane compounds, noble metal sensitization using compounds of noble metals such as gold complex salts, and complexes of the group VIII metals such as Pt, Ir or Pd, and the like may be employed either alone or in combination.

The silver halide composition of silver halide emulsions to be used in the present invention may be silver bromide, silver iodide, silver chloride, silver chlorobromide, silver bromoiodide or silver chlorobromoiodide. Of these emulsions, silver bromoiodide emulsions are preferred. Specifically, silver bromoiodide emulsions containing at least about 50 mol % of silver bromide are preferred. Particularly, silver bromoiodide emulsions containing up to about 15 mol % (including 0 mol %) of silver iodide are more preferred.

As to the crystal form of silver halide grains, grains of any form including tabular grains and regular grains (such as octahedral form and cubic form) may be used. As tabular grains, those of 5 or more, particularly 5 to 20, in aspect ratio may be used. Examples of such grains are those described in Japanese Patent Application (OPI) No. 108528/83.

The silver halide emulsion may be of the type wherein the latent image is formed mainly on the surface of grains (called "negative-working emulsion") or of the type where the latent image is formed mainly within grains (called internal latent image type emulsions which are used as direct positive emulsions). However, the present invention is preferably applied to the direct positive emulsions.

The internal latent image type silver halide emulsions can be clearly defined by the fact that maximum density obtained by developing with an "internal" developer is more than that obtained by developing with a "surface" developer.

Internal latent image type silver halide emulsions to which the present invention is applicable include conversion emulsions obtained by the catastrophic flocculation process of converting silver halide grains having more solubility such as silver chloride grains to silver halide grains having less solubility such as silver bromo(iodide). Such a process is described in U.S. Pat. No. 2,592,250. Core/shell type emulsions containing grains which comprise core grains having provided thereon a shell of silver halide and obtained by mixing a chemically sensitized large sized core emulsion with a fine grain emulsion and ripening the mixture may be used. Emulsions of this type are described in U.S. Pat. No. 3,206,313. The present invention is also applicable to core/shell type emulsions containing grains which comprise core grains having provided thereon a shell of silver halide and obtained by simultaneously adding to a chemically sensitized monodispersed emulsion a soluble silver salt solution and a soluble halide solution with keeping the concentration of silver ion at a constant level. This type of emulsion is described in British Patent 1,027,146 and U.S. Pat. No. 3,761,276. Other emulsions include halide-localized emulsions wherein emulsion grains have a structure of two or more layers different from each other in halide composition such as those described in U.S. Pat. No. 3,935,014 and emulsions containing silver halide grains which are formed in an acidic medium containing a trivalent metal ion and which therefore contain a different metal such as those described in U.S. Pat. No. 3,447,927. Of the above-described internal latent image type emulsions, core/-shell type emulsions are particularly preferable as emulsions to which the present invention is applied.

The nucleating agents of the present invention may be used in combination with conventionally known nucleating agents. Such conventional nucleating agents are not particularly limited, but may be selected from hydrazines such as those described in U.S. Pat. Nos. 2,563,785 and 2,588,982, hydrazides and hydrazones such as those described in U.S. Pat. No. 3,227,552, heterocyclic quaternary salt compounds such as those described in British Patent 1,283,835 and Japanese Patent Application (OPI) No. 69613/77 and U.S. Pat. Nos. 3,615,615, 3,719,494, 3,734,738, 4,094,683 and 4,115,122, sensitizing dyes having within the dye molecule a nucleating substituent such as those described in U.S. Pat. No. 3,718,470, thiourea-bound acylhydrazine compounds such as those described in U.S. Pat. Nos. 4,030,925, 4,031,127, 4,245,037, 4,255,511, 4,266,013 and 4,276,364 and British Patent 2,012,443, and acylhydrazine compounds having as an adsorptive group a thioamido ring group or a heterocyclic group (e.g., a triazolyl group or a tetrazolyl group) such as those described in U.S. Pat. Nos. 4,080,270 and 4,278,748 and British Patent 2,011,391B.

In the light-sensitive material of the present invention, the internal latent image type emulsions may be spectrally sensitized to a light of comparatively long wavelength, i.e., blue light, green light, red right or infrared light, by using a sensitizing dye. Suitable sensitizing dyes include cyanine dyes, merocyanine dyes, complex cyanine dyes, complex merocyanine dyes, holopolar cyanine dyes, styryl dyes, hemicyanine dyes, oxonol dyes, hemioxonol dyes. These sensitizing dyes include, for example, cyanine dyes and merocyanine dyes such as those described in Japanese Patent Application (OPI) Nos. 40638/84, 40636/84 and 38739/84.

Various compounds may be incorporated in the silver halide photographic emulsion to be used in the present invention for the purpose of preventing formation of fog or stabilizing photographic properties in the steps of producing, or during storage or processing of, light-sensitive materials. Such antifoggant or stabilizers include azoles such as benzothiazolium salts, nitroindazoles, triazoles, benzotriazoles and benzimidazoles (particularly nitro- or halogen-substituted derivatives thereof), heterocyclic mercapto compounds such as mercaptothiazoles, mercaptobenzothiazoles, mercaptobenzimidazoles, mercaptothiadiazoles, mercaptotetrazoles (particularly 1-phenyl-5-mercaptotetrazole) and mercaptopyrimidines, heterocyclic mercapto compounds as described above and including a water-soluble group such as a carboxyl group or a sulfo group, thioketo compounds such as oxazolinethiones, azaindenes such as tetraazaindenes (particularly 4-hydroxy-substituted (1,3,3a,7)tetraazaindenes), benzenethiosulfonic acids and benzenesulfinic acids.

The light-sensitive material of the present invention may contain in its photographic emulsion layers or other hydrophilic layers various surfactants for various purposes such as improvement of coating properties, antistatic properties, slipping properties, emulsion dispersibility, anti-adhesion properties, and photographic properties such as development acceleration, realization of contrasty tone and sensitization. Surfactants to be used for these purposes include those which are described in *Research Disclosure,* Vol. 176, Item 17643, XI (December, 1978, pp. 26–27).

Various color couplers may be used in the present invention as desired, and specific examples thereof are described in the patents mentioned in the foregoing *Research Disclosure,* RD No. 17643, VII-C-G. As dye-forming couplers, those couplers which form one of the three primary colors of subtractive color photography (i.e., yellow, magenta and cyan) by color development are important. In addition to the diffusion resistant 4- or 2-equivalent couplers described in the patents referred to in the foregoing *Research Disclosure,* RD No. 17643, VII-C and D, the following couplers are preferably used in the present invention.

Yellow couplers to be used include known oxygen atom coupling-off type or nitrogen atom coupling-off type couplers. α-Pivaloylacetanilide type couplers are excellent in fastness, particularly light fastness, of colored dyes, whereas α-benzoylacetanilide type couplers provide high coloration density.

Magenta couplers to be used in the present invention include 5-pyrazolone type and pyrazoloazole type couplers which have a ballast group and are hydrophobic. Of the 5-pyrazolone couplers, those which are substituted by an arylamino group or an acylamino group at 3-position are preferable in view of hue and coloration density of formed dyes.

Cyan couplers which may be used in the present invention include hydrophobic and diffusion resistant naphtholic and phenolic couplers. Typical examples thereof include oxygen atom coupling-off type, 2-equivalent naphtholic couplers. Couplers capable of forming cyan dyes fast against high humidity and high temperature are preferably used, and typical examples thereof include phenolic cyan couplers having an ethyl or more alkyl group at m-position of the phenol nucleus. Such couplers are described in U.S. Pat. No. 3,772,002. 2,5-Diacylamino-substituted phenolic couplers and phenolic couplers having a phenylureido group at 2-position and an acylamino group at 5-position may also be used.

Graininess can be improved by using those couplers which form dyes with proper diffusibility. Suitable couplers include those magenta couplers described in U.S. Pat. No. 4,366,237 and those yellow, magenta or cyan couplers described in European Patent 96,570.

The dye-forming couplers and the above-described special couplers may be in a form of a dimer or more polymerized polymer. Typical examples of such polymerized dye-forming couplers are described in U.S. Pat. No. 3,451,820. Specific examples of polymerized magenta couplers are described in U.S. Pat. No. 4,367,282.

Those couplers which release a photographically useful residue upon coupling reaction are also preferably usable in the present invention. As DIR couplers capable of releasing a development inhibitor, those couplers which are described in the patents mentioned in the foregoing *Research Disclosure,* RD No. 17643, VII-F, are useful.

In the light-sensitive material of the present invention, couplers may be used which imagewise release a nucleating agent, a development accelerator, or a precursor thereof upon development. Specific examples thereof are described in British Patents 2,097,140 and 2,131,188.

In addition, where the light-sensitive material of the present invention is adapted to a color diffusion transfer process, dye developing agents may be used as color-forming materials. As color-forming materials, those which are nondiffusible (immobile) in an alkaline solution (developer) but which, as a result of development, release a diffusible dye (or its precursor) may also be used. As the diffusible dye-releasing color-forming materials, there are illustrated diffusible dye-releasing couplers and redox compounds, which are useful not only for color diffusion transfer process (wet process) but for heat-sensitive recording (dry process) as well.

Known DRR compounds are used. For example, those described in *Research Disclosure,* Vol. 176, Item 17643, XXIII, column D, E and F (December, 1978) may be used.

The manner, format, etc., of the color diffusion transfer process and the silver salt diffusion transfer process are described in, for example, *Research Disclosure,* Vol. 176, Item 17643, XXIII A, B, C and G (December, 1978), ibid., Vol. 151, Item 15162, pp. 75 to 87 (November, 1976).

Supports of various materials for photographic use may be used in the light-sensitive material of the present invention. Silver halide emulsions may be coated on one or both sides of a support. Suitable supports are exemplified in *Research Disclosure,* Vol. 176, Item 17643, XVII (December, 1978).

The light-sensitive material of the present invention may be developed in a known manner. Suitable methods for development are described in *Research Disclosure,* Vol. 176, Item 17643, XIX to XXI (December, 1978), ibid., Vol. 151, Item 15162, p. 79, right column, line 30 to p. 80, left column, line 19 (November, 1976) and U.S. Pat. Nos. 4,224,401, 4,168,977.

In the interest of brevity and conciseness, the contents of the aforementioned numerous patents and articles are hereby incorporated by reference.

The present invention is now illustrated in greater detail by reference to the following examples which, however, are not to be construed as limiting the present invention in any way.

EXAMPLE 1

In manner analogous to that described in Japanese Patent Application (OPI) No. 95533/85, there was prepared an internal latent image type direct positive silver bromide emulsion containing silver bromide grains inside of which was chemically sensitized with sulfur and gold and the surface of which was chemically sensitized with sulfur. The grains were 1.0 μm octahedral grains. To this emulsion was added a compound of the present invention or a compound disclosed in U.S. Pat. No. 4,471,044 (for comparison), and each of the resulting solutions was coated on a cellulose acetate film support in a silver amount of 4.4 g/m$^2$ and a gelatin amount of 4.9 g/m$^2$ together with a protective layer (gelatin: 0.8 g/m$^2$). Each of the thus coated samples was exposed to 1,000 lux tungsten light for 1/10 second through a wedge of continuous gradation, then processed with Developer X (surface developer; pH=13.5) having the following formulation. Maximum density (Dmax) and minimum density (Dmin) of the thus obtained direct reversal imaees are shown in Table 1.

Developer X

| | |
|---|---|
| Sodium Sulfite | 30 g |
| Hydroquinone | 10 g |
| 1-Phenyl-4-methyl-4-hydroxymethyl-3-pyrazolidine | 0.75 g |
| Sodium Triphosphate | 40 g |
| Sodium Hydroxide | 10.7 g |
| 5-Methylbenzotriazole | 0.02 g |
| Water to make | 1 liter |

It is seen from Table 1 that the compounds of the present invention show better reversal properties than the comparative compound.

TABLE 1

| Nucleating Agent | Added Amount (mmol/mol Ag) | Dmax | Dmin | Note |
|---|---|---|---|---|
| None | — | 0.07 | 0.07 | Comparison |
| Compound (1) | 0.004 | 1.90 | 0.07 | Invention |
| Compound (3) | 0.004 | 1.98 | 0.07 | Invention |
| Compound (11) | 0.004 | 1.70 | 0.08 | Invention |
| Comparative Compound (A) | 0.004 | 1.50 | 0.12 | Comparison |

Comparative Compound (A): (disclosed in U.S. Pat. No. 4,471,044)

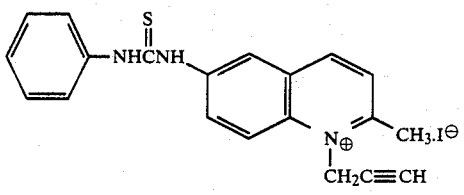

EXAMPLE 2

To the same internal latent image direct positive emulsion as in Example 1 was added a compound of the present invention or Comparative Compound (A), and coated samples were prepared in the same manner as in Example 1 using the resulting emulsions. These samples were imagewise exposed under the same exposure conditions as in Example 1, and processed with Developer Y of the following formulation having a less pH (pH=10.7) than Developer X. Maximum density (Dmax) and minimum density (Dmin) of the thus obtained direct reversal images are shown in Table 2.

Developer Y

| | |
|---|---|
| Sodium Sulfite | 30 g |
| Hydroquinone | 10 g |
| 1-Phenyl-4-methyl-4-hydroxymethyl-3-pyrazolidine | 0.75 g |
| Sodium Triphosphate | 40 g |
| 5-Methylbenzotriazole | 0.02 g |
| Water to make | 1 liter |

It is seen from Table 2 that the compounds of the present invention show better reversal properties than Comparative Compoound (A) at a lower pH level as well.

TABLE 2

| Nucleating Agent | Added Amount (mmol/mol Ag) | Dmax | Dmin | Note |
|---|---|---|---|---|
| None | — | 0.04 | 0.04 | Comparison |
| Compound (1) | 0.095 | 2.02 | 0.04 | Invention |
| Compound (3) | 0.095 | 2.08 | 0.05 | Invention |
| Compound (11) | 0.095 | 1.85 | 0.04 | Invention |
| Compound (21) | 0.095 | 2.04 | 0.04 | Invention |
| Comparative | 0.095 | 1.80 | 0.08 | Comparison |

TABLE 2-continued

| Nucleating Agent | Added Amount (mmol/mol Ag) | Dmax | Dmin | Note |
|---|---|---|---|---|
| Compound (A) | | | | |

Comparative Compound (A): (disclosed in U.S. Pat. No. 4,471,044)

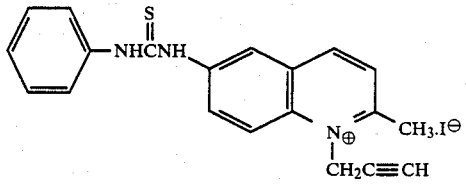

EXAMPLE 3

On a polyethylene terephthalate transparent support were coated in sequence the following layers to prepare four kinds of Color Direct Positive Light-Sensitive Material Sheets (A) to (D).

(1) Mordanting layer containing the following copolymer (3.0 g/m$^2$) and gelatin (3.0 g/m$^2$).

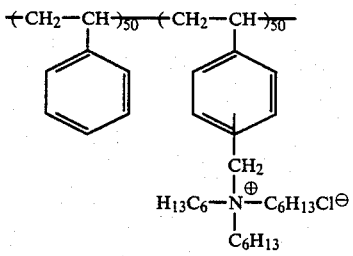

(2) White reflecting layer containing titanium oxide (18 g/m$^2$) and gelatin (2.0 g/m$^2$).

(3) Light barrier layer containing carbon black (2.0 g/m$^2$) and gelatin (1.0 g/m$^2$).

(4) Layer containing the magenta DRR compound of the following structural formula I (0.21 g/m$^2$), the magenta DRR compound of the structural formula II (0.11 g/m$^2$), tricyclohexyl phosphate (0.08 g/m$^2$), 2,5-di-tert-pentadecylhydroquinone (0.009 g/m$^2$), and gelatin (0.9 g/m$^2$)

Structural Formula I:

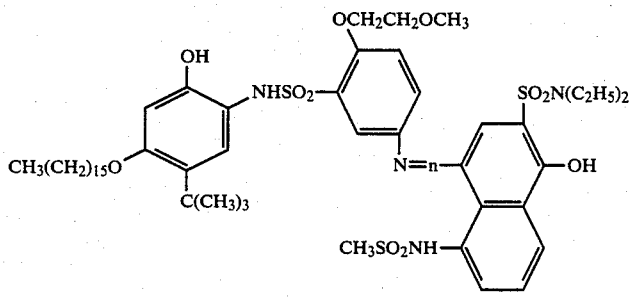

Structural Formula II:

-continued

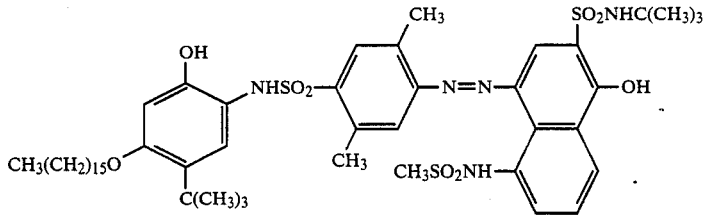

(5) Green-sensitive emulsion layer containing a dye-sensitized internal latent image type direct positive silver bromide emulsion (0.82 g/m$^2$ in terms of silver amount), gelatin (0.9 g/m$^2$), 2-sulfo-5-n-pentadecylhydroquinone sodium salt (0.08 g/m$^2$) and a nucleating agent of the present invention for each light-sensitive material sheet ($10^{-10}$ mol to $10^{-9}$ mol per g of emulsion).

(6) Protective layer containing gelatin (1.0 g/m$^2$).

The above-described Light-Sensitive Sheets (A) to (D) were combined with a processing element and a cover sheet shown below, and were subjected to exposure and development processing.

Processing Elements

Processing Solution

| | |
|---|---|
| 1-Phenyl-4-methyl-4-hydroxymethyl-3-pyrazolidone | 8.0 g |
| tert-Butylhydroquinone | 0.1 g |
| 5-Methylbenzotriazole | 2.5 g |
| Benzyl Alcohol | 1.5 ml |
| Sodium Sulfite (anhydrous) | 1.5 g |
| Na Salt of Carboxymethyl Cellulose | 61 g |
| Zinc Nitrate Hexahydrate | 0.4 g |
| Carbon Black | 410 g |
| Potassium Hydroxide | 56 g |
| $H_2O$ | 260 ml |

0.8 g portions of the processing solution having the above-described formulation were retained in a "pressure-rupturable container".

Cover Sheet

A cover sheet was prepared by coating in sequence an acidic polymer layer (neutralizing layer) of polyacrylic acid (viscosity as 10 wt % aqueous solution: about 1,000 cp) (15 g/m$^2$) and a neutralization timing layer of acetyl cellulose (3.8 g/m2) and styrene/maleic anhydride copolymer (molar ratio: styrene : maleic anhydride=about 60:40; molecular weight: about 50,000) (0.2 g/m$^2$) on a polyethylene terephthalate support.

Processing Steps

The above-described cover sheet was superposed on each of the aforesaid light-sensitive sheets, and wedge exposure was conducted for 1/100 second from the cover sheet side using a tungsten light source. Then, the above-described processing solution was spread in a thickness of 100 μm between the two sheets using pressure-applying rollers. The spread processing was conducted at 25° C. After the processing, green density of image formed in the image-receiving layer was measured 1 hour after the processing through the transparent support of the light-sensitive sheet. The results thus obtained are tabulated in Table 3.

It is seen from Table 3 that the nucleating agents of the present invention show good reversal properties in color direct positive light-sensitive materials as well.

TABLE 3

| Light-Sensitive Material | Nucleating Agent | Added Amount (mmol/g emulsion) | Dmax | Dmin | Note |
|---|---|---|---|---|---|
| A | None | — | 0.05 | 0.05 | Comparison |
| B | Compound (1) | $5.0 \times 10^{-6}$ | 2.10 | 0.06 | Invention |
| C | Compound (11) | $5.0 \times 10^{-6}$ | 2.15 | 0.07 | Invention |
| D | Compound (21) | $5.0 \times 10^{-6}$ | 2.08 | 0.06 | Invention |

EXAMPLE 4

An emulsion prepared by adding Sensitizing Dye E ($9.5 \times 10^{-5}$ mol) and a compound of the present invention or Comparative Compound (A) to 1 kg of a silver bromide emulsion prepared in a conventional manner (having (100) face) was coated on a triacetate film support, and dried to obtain photographic light-sensitive materials.

The light-sensitive materials were exposed through an optical wedge (for 0.1 second) at 3,200 lux using a light source fitted with a yellow filter (SC-46, made by Fuji Photo Film Co., Ltd.).

The exposed materials were developed at 20° C. for 5 minutes using a developer of the following formulation, and were subjected to conventional stopping, fixing, and washing steps to obtain strips with a given black-and-white image. Density of the image was measured using a densitometer of model TCD made by Fuji Photo Film Co., Ltd. to obtain yellow filter sensitivity ($S_Y$) and fog value. The results thus obtained are shown in Table 4 as relative values taking the point of (fog+0.10) as a standard point of optical density for determining sensitivity.

Formulation of Developer

| | |
|---|---|
| Water | 500 ml |
| Metol | 2 g |
| Anhydrous Sodium Sulfite | 90 g |
| Hydroquinone | 8 g |
| Sodium Carbonate Monohydrate | 52.5 g |
| Potassium Bromide | 5 g |
| Water to make | 1 liter |

A comparison of the sensitivity values listed in Table 4 clearly shows that the compounds of the present invention have the effect of enhancing photographic sensitivity when compared to Comparative Compound (A).

TABLE 4

| Nucleating Agent | Added Amount (mmol/kg emulsion) | Relative Sensitivity | Fog Density | Note |
|---|---|---|---|---|
| None | — | 100 (standard) | 0.04 | Comparison |
| Compound (1) | $4.0 \times 10^{-3}$ | 155 | 0.04 | Invention |
| Compound (11) | $4.0 \times 10^{-3}$ | 143 | 0.04 | Invention |
| Comparative Compound (A) | $4.0 \times 10^{-3}$ | 141 | 0.04 | Comparison |

Sensitising Dye E

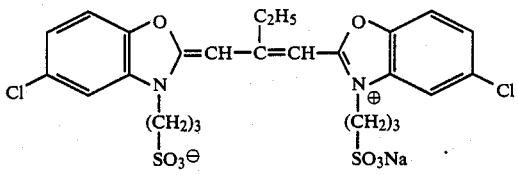

Comparative Compound (A) (disclosed in U.S. Pat No. 4,471,044)

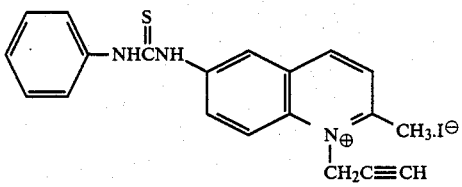

While the invention has been described in detail and with reference to specific embodiments thereof, it will be apparent to one skilled in the art that various changes and modifications can be made therein without departing from the spirit and scope thereof.

What is claimed is:

1. A silver halide photographic material, which comprises a support having provided thereon at least one hydrophilic layer containing at least one alkynyl-substituted heterocyclic quaternary ammonium salt nucleating agent represented by the following general formula (I):

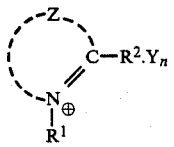

(I)

wherein Z represents non-metallic atoms necessary for forming a 5- or 6-membered heterocyclic nucleus;

$R^1$ represents an aliphatic group, and $R^2$ represents a hydrogen atom, an aliphatic group or an aromatic group, at least one of $R^1$, $R^2$ and Z having an alkynyl group, and at least one of the substituents $R^1$ and Z including the group $X\text{-}(L)_m$- wherein X represents a group effective for accelerating adsorption onto silver halide grains which is not a thioamido group and is selected from at least one of a mercapto group, a 5-membered nitrogen-containing heterocyclic group or a 6-membered heterocyclic group, and wherein L represents a divalent linking group;

Y represents a charge-balancing counter ion;

n represents 0 or 1; and m represents 0 or 1.

2. The silver halide photographic material of claim 1, wherein said hydrophilic layer is a silver halide light-sensitive layer.

3. The silver halide photographic material of claim 2, wherein said at least one alkynyl-substituted heterocyclic quaternary ammonium salt is present in an amount of about $1\times10^{-7}$ mol to about $1\times10^{-2}$ mol per mol of silver in the silver halide layer.

4. The silver halide photographic material of claim 3, wherein said at least one alkynyl-substituted heterocyclic quaternary ammonium salt is present in an amount of about $1\times10^{-6}$ mol to about $1\times10^{-3}$ mol per mol of silver in the silver halide layer.

5. The silver halide photographic material of claim 2, wherein said silver halide light-sensitive layer is an internal latent image silver halide photographic emulsion layer.

6. The silver halide photographic material of claim 5, wherein said at least one alkynyl-substituted heterocyclic quaternary ammonium salt is present in an amount of about $1\times10^{-5}$ mol to about $1\times10^{-3}$ mol per mol of silver in the silver halide layer.

7. The silver halide photographic material of claim 2, wherein said silver halide light-sensitive layer is a surface latent image silver halide photographic emulsion layer.

8. The silver halide photographic material of claim 7, wherein said at least one alkynyl-substituted heterocyclic quaternary ammonium salt is present in an amount of about $1\times10^{-5}$ mol to about $1\times10^{-3}$ mol per mol of silver in the silver halide layer.

9. The silver halide photographic material of claim 1, further comprising at least one silver halide lyer adjacent to the hydrophilic layer wherein said hydrophilic layer is a hydrophilic colloidal layer.

10. The silver halide photographic material of claim 9, wherein said at least one alkynyl-substituted heterocyclic quaternary ammonium salt is present in an amount of about $1\times10^{-7}$ mol to about $1\times10^{-2}$ mol per mol of silver in the silver halide layer.

11. The silver halide photographic material of claim 1, wherein at least one of $R^1$ or $R^2$ is substituted with at least one substituent.

12. The silver halide photographic material of claim 2, wherein said silver halide light-sensitive layer includes at least one of silver bromide, silver iodide, silver chloride, silver chlorobromide, silver bromoiodide or silver chlorobromoiodide.

13. The silver halide photographic material of claim 12, wherein said silver halide light-sensitive layer includes silver bromoiodide containing up to 15 mol % silver iodide.

14. The silver halide photographic material of claim 12, wherein said silver halide light-sensitive layer includes silver bromoiodide containing at least 50 mol % silver bromide.

15. The silver halide photographic material of claim 9, wherein said silver halide light-sensitive layer includes at least one of silver bromide, silver iodide, silver chloride, silver chlorobromide, silver bromoiodide or silver chlorobromoiodide.

16. The silver halide photographic material of claim 15, wherein said silver halide light-sensitive layer includes silver bromoiodide containing up to 15 mol % silver iodide.

17. The silver halide photographic material of claim 15, wherein said silver halide light-sensitive layer includes silver bromoiodide containing at least 50 mol % silver bromide.

18. The silver halide photographic material of claim 5, wherein said internal latent image silver halide photographic emulsion layer is a core/shell emulsion.

19. The silver halide photographic material of claim 1, wherein the 5- or 6-membered heterocyclic nucleus is substituted with at least one substituent.

* * * * *